United States Patent [19]

Baillet et al.

[11] Patent Number: 4,776,815

[45] Date of Patent: Oct. 11, 1988

[54] RAIL-MOUNTED TERMINAL BLOCK

[75] Inventors: Alain Baillet, Montville; Jean-Pierre Barriuso, Buchy; Francois Loisel, Maromme; Bruno Mullot, Rouen, all of France

[73] Assignee: Legrand, Limoges, France

[21] Appl. No.: 7,082

[22] Filed: Jan. 27, 1987

[30] Foreign Application Priority Data

Jan. 29, 1986 [FR] France ..... 86 01239

[51] Int. Cl.[4] ..... H01R 11/09

[52] U.S. Cl. ..... 439/724; 439/712

[58] Field of Search ..... 439/709, 710, 711, 712, 439/715, 716, 724, 714

[56] References Cited

U.S. PATENT DOCUMENTS 3,201,747 8/1965 Blanchet ..... 439/716
4,220,392 9/1980 Debaigt ..... 439/716
4,269,471 5/1981 Woertz ..... 439/716

FOREIGN PATENT DOCUMENTS 2410207 6/1979 France .
2435138 3/1980 France .
2578693 9/1986 France .
2619506 11/1977 Fed. Rep. of Germany .
628467 2/1982 Switzerland .

*Primary Examiner*—Eugene F. Desmond
*Attorney, Agent, or Firm*—Charles E. Brown; Charles A. Brown

[57] ABSTRACT

A terminal block includes a housing adapted to be fixed to a support rail which has two flanges each with a right-angle lip along its free edge. Inside the housing are a metal bearing member which is fixed relative to the housing and a metal clamping member which is movable relative to the bearing member. Both these members have two branches. A screw passes through a bore in the bearing member. Hook faces on respective branches of the bearing member face towards the head of the screw and bearing faces on respective branches of the clamping member face away from the head of the screw. When the terminal block is mounted on a support rail at least one of the hook faces and at least one of the bearing faces bear on the rail. The clamping member is U-shaped, having a central part on the side of the bearing member opposite the head of the screw and side flanges embracing the bearing member. This central part is attached to the screw but can rotate relative to the screw.

20 Claims, 2 Drawing Sheets

RAIL-MOUNTED TERMINAL BLOCK

BACKGROUND OF THE INVENTION

1. Field of the invention

The present invention is generally concerned with terminal blocks which mount on a rail and is more particularly directed to terminal blocks of this kind, usually called grounding blocks, designed to be used where the supporting rail serves as the main protection conductor for circuits which branch from it.

2. Description of the prior art

Known rails as usually employed for supporting electrical equipment are of two broad types: symmetrical rails, with a so-called hat-shape profile, and asymmetrical rails with a so-called G-shape profile.

All such rails, which are broadly U-shaped, have right-angle flanges featuring right-angle lips along their free edges so that equipment and terminal blocks may be attached to them.

In symmetrical rails, which further subdivide into numerous categories, specifically with regard to the depth and the thickness of the material from which they are made, these right-angle lips face outwards and thus extend away from each other, and are in the same plane.

In asymmetric rails the right-angle lips of the side flanges are directed inwardly, however, and so extend towards each other; they are not coplanar.

For mounting them on a rail of this kind, terminal blocks generally comprise, in a housing, a bearing member fixed relative to the housing and having two branches at least one of which is adapted to come into contact with the rail, to be more precise the right-angle lip on at least one of the flanges thereof, and, movable relative to the bearing member by a screw passing through the bearing member by means of a bore provided in it for this purpose, a clamping member also having two branches at least one of which is adapted to come into contact with the rail, to be more precise with the right-angle lip on at least one of the flanges thereof. In practise these terminal blocks are adapted to grip the right-angle lip on at least one of the flanges of the rail on which they are mounted, whereby they are fixed to the rail, through the intermediary of the bearing member and the clamping member at least one of which, and preferably both of which, is or are of metal to procure the necessary grounding contact.

To be more precise, in currently known terminal blocks, in order to achieve this clamping, the clamping member usually moves towards the head of the screw as this is screwed in and the faces on it designed to come into contact with the rail face generally towards the head of the screw so that they form hook faces, meaning faces adapted to interact with the right-angle lip on at least one of the flanges of a rail of this kind from below; conjointly, the faces through which the bearing member is adapted to come into contact with the rail usually face generally away from the head of the screw, in this case forming simple bearing faces, meaning faces adapted to interact with the right-angle lip on at least one of the flanges of the rail from above.

In other words, in currently known terminal blocks the bearing member usually acts in compression and the clamping member in tension.

This is the case, for example, with the terminal block that is the subject of German patent application No. 2 619 506 in which the massive clamping member also requires a special nut appropriately set into a cut-out in the clamping member, which is detrimental to the cost price of the assembly.

However, there have already been proposed terminal blocks in which the contact faces of the clamping member face generally away from the head of the screw, so that the clamping member, which is the movable part, is operative in compression whereas the bearing member, which is the fixed part, is operative in tension, its contact faces facing generally towards the head of the screw.

This is the case, for example, in the terminal block that is the subject of published French patent application No. 2 435 138.

However, in this terminal block, which incidentally does not comprise any housing, the clamping member is, like the bearing member, a massive part and is entirely contained within the internal contour of the bearing member, as a result of which it has extremely limited capacity of movement relative to the latter in the direction along the axis of the screw. Also, being massive, the clamping member prevents the provision of any form of hook face on the bearing member, between the branches thereof.

Because of this, the terminal block in question can only be fitted to a specific type of rail, in this instance a symmetrical rail with a hat-shape profile.

It cannot be mounted on an asymmetric rail having a G-shape profile.

In order to minimize the number of terminal blocks that have to be provided to cover all the range of rails that may be encountered, a terminal block should preferably be adapted to fit either onto a symmetrical rail, of whatever type, or onto an asymmetric rail.

This is the case, for example, with the terminal block that is the subject of published French patent application No. 2 410 207.

However, apart from the fact that the terminal block in question is of relatively complex construction, this embodiment necessitates the use only of a bearing member, a clamping member and a screw, but also of a nut which, engaged on the screw, cooperates with openings provided for it in the bearing member and in the clamping member; the clamping member moves not only in a straight line along the axis of the screw but also pivots, the assembly that is forms with the screw and the nut engaged on the screw being able to tilt relative to the associated bearing part; this tilting movement is necessary for the clamping member to be able to interact with the right-angle lip on at least one of the flanges of the rail from below, and also to avoid any possibility of interference between its movements during fitting to a symmetrical rail and during fitting to an asymmetric rail, and results in some uncertainty as to the final position of the clamping member when locked onto the rail, which is detrimental to the mechanical force with which it is retained on the rail and its centering relative to the rail.

Also, in the terminal block in question the rail is in practise gripped through the right-angle lip on only one of its flanges, there being merely a bearing or hooking relationship with the right-angle lip of the other flange.

As a result the terminal block assembly bears asymmetrically on the rail, further prejudicing the mechanical force with which it is retained on the rail with the result that the resistance of a terminal block of this kind to pulling off is not always totally satisfactory, especially where it is subject to twisting or torsional forces relative to the rail.

Finally, mistakes can occur when fitting the terminal block in question whereas, during removal, it may be difficult to disengage the terminal block from the rail.

A general objective of the present invention is an arrangement by which these disadvantages can be avoided and conferring other advantages.

SUMMARY OF THE INVENTION

The present invention consists in a terminal block comprising a housing adapted to enable the terminal block to be fixed to a rail which has two flanges each with a right-angle lip along the free edge, a metal bearing member in and fixed relative to the housing and having two branches, a metal clamping member in the housing and movable relative to the bearing member and having two branches, a bore in the bearing member, a screw passing through the bore, a head on the screw, hook faces on respective branches of the bearing member facing towards the head of the screw, and bearing faces on respective branches of the clamping member facing away from the head of the screw, wherein at least one of the hook faces and at least one of the bearing faces is adapted to come into contact with the rail, the clamping member is U-shaped having a central part on the side of the bearing member opposite the head of the screw and side flanges embracing the bearing member, and the central part of the clamping member is attached to but rotatable relative to the screw.

Swiss Pat. No. 628 467 describes a terminal block in which part of the clamping member has a U-shaped configuration.

However, in this case the clamping member in practise constitutes a lever which is pivoted to the bearing member at one point thereon and can engage only one of the right-angle lips of the rail concerned.

Thus is does not constitute a member having two branches each of which has a rail contact face, which means that the coupling of the corresponding terminal block to the rail is less secure.

Also, this terminal block can only be fitted to one type of rail, in this instance a symmetrical rail.

This does not apply in the case of the terminal block in accordance with the invention, which, because of the significant capacity for movement of the clamping member along the axis of the screw and of the possibility of an intermediate hook face being provided on the bearing member, by virtue of the design of the clamping member and the way in which it is engaged with the bearing member, has the advantage of being able to be fitted to a symmetrical rail, of any type, or to an asymmetric rail.

In the terminal block in accordance with the invention, and by virtue of a characteristic arrangement which is the opposite of that usually adopted, the clamping member moves away from the head of the screw when this is screwed in and, whereas the bearing member is then operative in tension, the clamping member is operative in compression.

It is therefore perhaps somewhat misleading that this member should be called the clamping member in this instance, as its function is rather a bearing function; however, as it is the other member that is fixed relative to the housing it is the other member which is here conventionally designated the bearing member.

Be this as it may, clamping is advantageously applied by turning the screw in the usual screw tightening direction.

The terminal block in accordance with the invention also has a number of other advantages.

Firstly, the bearing member and the clamping member that is comprises are relatively simple parts and there is no need to associate with them any additional part in the form of a nut.

The bore in the bearing member is threaded to form a nut, the screw being screwed into this bore, and the clamping member is simply attached to the screw, on the side of the bearing member opposite the head of the screw, whilst being free to rotate relative to the screw.

Apart from the resulting simplicity, this makes it possible to provide a relatively long thread, considerably longer in any event than that available on a simple nut, and this favors the obtaining of a good clamping torque and therefore good mechanical retention of the assembly onto a rail.

Also, as the rail is gripped from above, it is advantageously possible for the clamping member to have a simple rectilinear movement, namely a simple vertical translation movement along the axis of the screw, without any tilting movement.

Apart from the fact that fitting of the assembly to and removing it from a rail are facilitated by this arrangement, it is advantageously possible to exploit this simple vertical movement of the clamping member to ensure that its final position, gripping at least one of the right-angle lips on the flanges of the rail concerned, is accurately predetermined, which favors accurate positioning of the terminal block in accordance with the invention on a rail of this kind.

In accordance with the invention, the clamping member preferably has two oblique faces which are convergent in the direction towards the head of the screw and one of which is designed to cooperate with the upper edge of the edge surface of the right-angle lip of one of the lateral flanges of a symmetrical rail having a hat-shape profile, the other being designed to cooperate with the upper edge of the edge surface of the lower right-angle lip of an asymmetric rail having a G-shape profile.

Thus whatever the type of rail the terminal block in accordance with the invention is advantageously always centered on it.

The terminal block may also and advantageously bear symmetrically on the rail on which it is mounted, with the right-angle lip on each of the flanges of the rail actually being gripped, at least in the case of symmetrical rails.

To summarize, because of the effective clamping torque obtained and because the symmetrical bearing action is well distributed between the right-angle lips of the rail, mechanical retention of a terminal block in accordance with the invention on a rail of this kind, and in particular its resistance to any possible twisting or torsional forces, is entirely satisfactory, being in all cases significantly better, other things being equal, than that achieved in the prior art; this is of particular benefit in the case of terminal blocks used as immobilizers at the end of a row of terminal blocks.

Finally, with the terminal block in accordance with the invention the risks of defective mounting on a rail are minimized if not eliminated.

The characteristics and advantages of the invention will emerge from the following description given by way of example only with reference to the appended schematic drawings.

DESCRIPTION OF THE PREFERRED EMBODIMENT

Figure 8A:
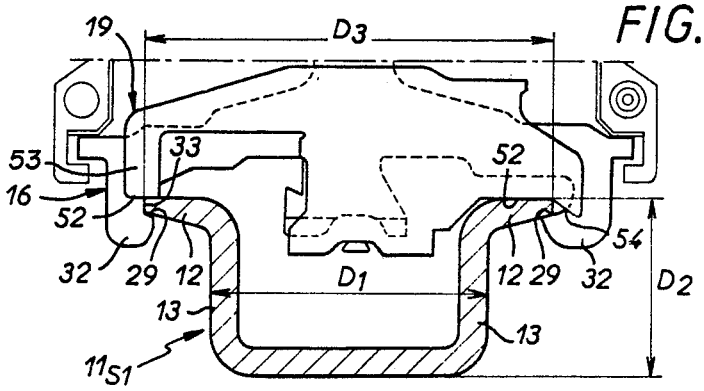
FIGS. 8A, 8B and 8C are views repeating in part and to a larger scale that of FIG. 6, showing the terminal block in accordance with the invention fitted to various types of rail.
Figure 7:
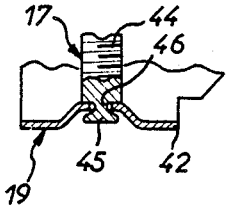
FIG. 7 is a partial view in elevation and cross-section showing the connection between the bearing member and the screw.
Figure 8B:
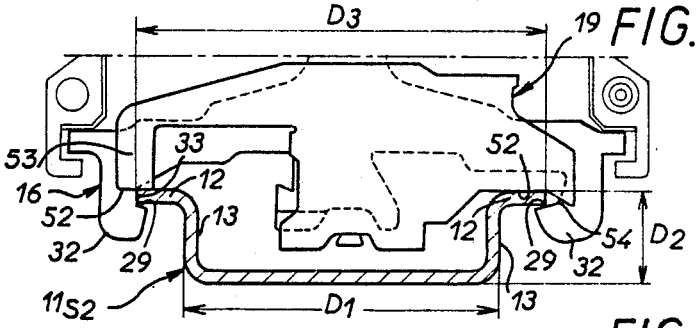
Figure 8C:
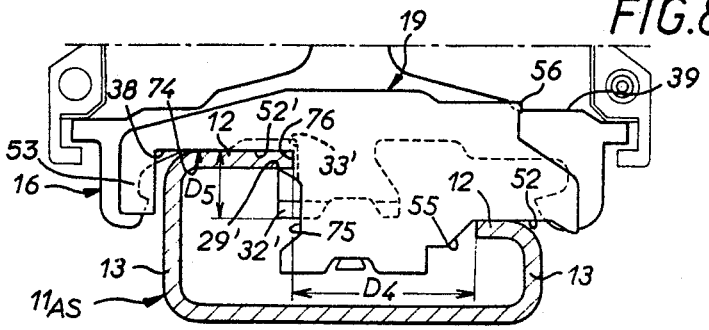

The figures show a terminal block 10 in accordance with the invention designed to be fitted to any type of rail 11, whether this is a symmetrical rail $11S_1$ or $11S_2$ (FIG. 8A or 8B) or an asymmetric rail 11AS (FIG. 8C).

As already mentioned, for a known symmetrical rail having a so-called hat-shape profile the right-angle lips 12 along the free edges of the lateral flanges 13 extend away from each other and are coplanar.

The distance D1 between the lateral flanges 13 varies with the type of symmetrical rail employed, and the same goes for the height D2; however, according to the standard EN 50.022 covering this type of rail, the distance D3 between the opposite edges of the right-angle lips 12 on the side flanges 13 is always the same.

The symmetrical rail $11S_1$ shown in FIG. 8A is relatively deep and narrow, the material being relatively thin and featuring a tapered profile for the right-angle lips 12, whereas the symmetrical rail $11S_2$ shown in FIG. 8B is relatively shallow and wide, the material being relatively thick and the right-angle lips 12 not featuring a tapered profile.

For an asymmetric rail (FIG. 8C) with a so-called G-shape profile, the right-angle lips 12 both extend inwardly, so that they are directed generally towards each other, and they are not coplanar.

According to the applicable standard EN 50 035, the distance D4 between the edge surfaces of the right-angle lips 12 of the flanges 13 is precisely defined, as is the difference D5 between the levels of the right-angle lips 12.

Such rails 11 are well known in themselves and as they do not of themselves form part of the present invention they will not be described in more detail here.

For the purpose of fixing it to a rail 11 the terminal block 10 in accordance with the invention comprises, in a housing 15 to be described later, a first member 16 referred to hereinafter for convenience as the bearing member which is fixed relative to the housing 15 and a second member 19 referred to hereinafter for convenience as the clamping member which is movable relative to the bearing member 16 by a screw 17 which passes through a bore 18 provided in the bearing member 16 for this purpose.

The bearing member 16 is of metal, such as brass, for example, and is generally formed by a length of extrusion, or a cut out part, or a casting, and it comprises a central shank 20 along the axis of which is the bore 18.

The bore 18 is threaded and the screw 17 is screwed into it.

At the upper end of the central shank 20 the bearing member 16 comprises two branches 22, referred to as the upper branches, each extending to a respective side of the central shank 20, in substantially horizontal and opposite directions, and therefore substantially perpendicularly to the axis of the threaded bore 18 in the central shank 20, and cooperating with respective connecting terminals 23 of the usual type including a clamping screw 24.

In the vicinity of the central shank 20 each of the upper branches 22 has a projecting shoulder 25 on the upper surface against which the corresponding terminal 23 abuts in the assembled terminal block, as will be described in more detail hereinafter.

To minimize the amount of material required, the corresponding shoulders 25 form part of projections between which the upper face of the central shank 20 is recessed.

The central shank 20 also has a recess 26 on each side, under the respective upper branches 22, for the same reasons and also to provide room behind the terminal for the conductive core of the electrical cable inserted into each terminal 23.

The lower surface of each of the upper branches 22 is preferably grooved, as shown here.

At the base of the central shank 20 the bearing member 16 has two lower branches 28, generally parallel to the previously mentioned upper branches 22 and extending to respective sides of the central shank 20, in opposite directions.

It is through the lower branches 28 that the bearing member 16 is adapted to come into contact with a rail 11.

To this end each of the lower branches 28 has at least one face 29, 29' adapted to procure such contact.

These are hook faces, that is to say surfaces which, facing generally towards the head 30 of the screw 17, are each designed to bear on the bottom of the right-angle lip 12 of one of the flanges 13 of a rail 11. Only the bearing member 16 features such hook faces 29, 29'.

To be more precise, the bearing member 16 comprises at the ends of its lower branches 28 two hooks 32 each carried by a respective one of the lower branches 28 and projecting from it in the direction away from the head 30 of the screw 17; the hooks 32 have hook faces 29 at substantially the same level and facing towards each other, and through these the bearing member 16 is adapted to hook on to the right-angle lips 12 of the side flanges 13 of a symmetrical rail with hat-shape profile $11S_1$ or $11S_2$.

Figure 1:
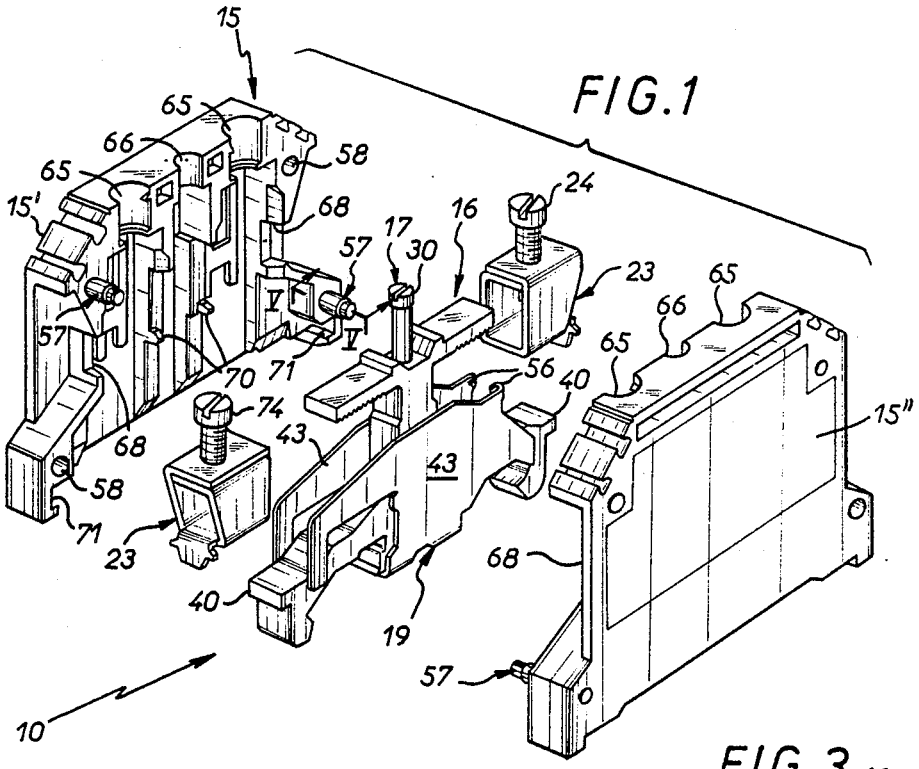
FIG. 1 is an exploded view in perspective of a terminal block in accordance with the invention.
Figure 2:
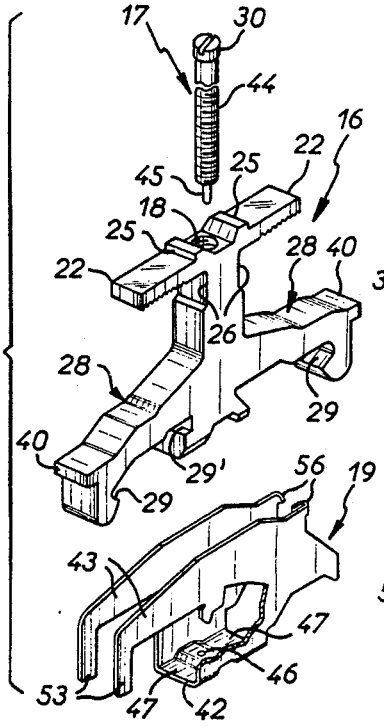
FIG. 2 is a locally cut away exploded view in perspective of the screw, the bearing member and the clamping member that the terminal block comprises.
Figure 3:
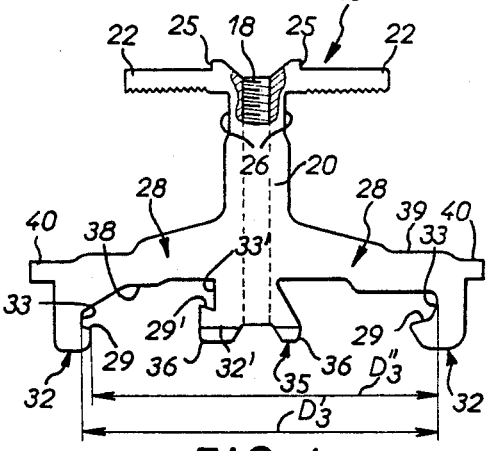
FIG. 3 is a locally cut away view in elevation of the bearing member of the terminal block, shown in isolation.

The two hook faces 29' are not of the same size as measured in the direction away from the back or or bight portion 33 of the hook 32 of which they form part: for reasons that will emerge later, that which is on the righthand side of the central shank 20 in FIG. 3 is of greater size as measured from the back 33 of the corresponding hook 32 to its free edge than the other.

For manufacturing reasons in particular, and also for better adaptation to the specific profile of the inclined lower surface of the right-angle lips 12 of a symmetrical rail $11S_1$, at least one of the hook faces 29 preferably extends slightly obliquely to the horizontal, in the direction away from the head 30 of the screw 17, from the back 33 of the corresponding hook 32 to its free edge.

This applies to both the hook faces 29 which therefore converge in the direction away from the head 30 of the screw 17.

As an alternative to this, however, the smaller hook face 29, that is to say that to the lefthand side of the central shank 20 in FIG. 3, could equally well extend horizontally, that is to say substantially perpendicular to the axis of the threaded bore 18 in the central shank 20, if required.

In its central area the bearing member 16 has a third hook 32' facing away from the head 30 of the screw 17 and facing towards one of the two previously mentioned hooks 32; however, its hook face 29' is offset relative to the hook face 29 of the hook 32 it faces in the direction towards the head 30 of the screw 17, in order to hook onto the upper right-angle lip 12 of a G-shape profile asymmetric rail 11AS.

The third hook 32' which is to the left of the central shank 20 in FIG. 3 faces towards the hook 32 which has the smaller hook face 29.

Thus overall it has the opposite orientation to this hook 32, although it is generally oriented in the same direction as the other of the hooks 32, meaning that with the larger hook face 29.

The hook face 29' also extends obliquely, but with an orientation that is opposite that of the previously mentioned hook faces 29, converging towards the head 30 of the screw 17 in the direction away from the back or or bight portion 33' of the corresponding hook 32' to its free edge.

As an alternative to this the hook face 29' could equally well be horizontal and thus extend substantially perpendicularly to the axis of the threaded bore 18 in the central shank 20, if required.

The third hook 32' in practice forms part of a foot member 35 of the bearing member 16 which, generally aligned with the central shank 20 of the latter, beyond its lower branches 28, and having the threaded bore 18 in the central shank 20 continued through it, forms two bearing heels or studs 36 disposed on respective sides of the threaded bore 18 and adapted to have the associated clamping member 19 abut against them in the latter's raised position, as will emerge hereinafter.

The lateral surfaces of the studs 36 are chamfered and the surface between them is recessed to minimize the amount of material needed.

The back 33 of at least the hook 32 towards which the third hook 32' faces, meaning that with the smaller hook face 29, extends in a straight line parallel to the axis of the threaded bore 18 in the central shank 20.

The distance D'3 separating this back 33 from the back 33 of the other hook 32 is, of course, greater than the distance D3 between the facing edge surfaces of the right-angle lips 12 of the flanges 13 of a symmetrical rail 11S.

For reasons that will emerge later, the distance D''3 between the back 33 of this other hook 32 and the free edge of the previous one, which is obviously less than the distance D'3, has also to be greater than the distance D3 in question.

The back 33' of the third hook 32' is also preferably straight, as shown.

On the side facing away from the head 30 of the screw 17, that is to say on its lower surface, the lower branch 28 of the bearing member 16 that comprises two hooks 32, 32' facing towards each other has, between the hooks 32, 32', a plane face 38 perpendicular to the axis of the threaded bore 18 in the central shank 20, through which it bears on the upper right-angle lip 12 of an asymmetrical rail 11AS.

On the side facing towards the head 30 of the screw 17, that is to say on its upper surface, the other lower branch 28 of the bearing member 16, that is to say that of the lower branches 28 which has downwardly projecting on its lower surface the hook 32 with the larger hook face 29, has a plane face 39 perpendicular to the axis of the threaded bore 18 in the central shank 20, designed to cooperate with tangs that the clamping member 19 comprises for this purpose, as will emerge hereinafter.

The bearing member 16 has at respective ends of its lower branches 28 and extending away from each other two tabs 40 by means of which, as will be described in more detail later, it is engaged with the housing 15 so as to lock it in position in the latter.

The profile of the upper and lower surfaces of the lower branches 28 of the bearing member 16 is preferably such as to minimize the amount of material required.

Thus, as shown here, the profile of these surfaces features various recesses.

The clamping member 19 is generally U-shaped, having a central part 42 and two side flanges 43.

Like the bearing member 16, this part is made from metal, for example a piece of sheet metal appropriately cut out and bent to shape.

As an alternative to this, however, it could equally well be a casting or a section of extrusion.

Its side flanges 43 embrace the bearing member 16, with its central part 42 disposed on the same side as the foot member 35 thereof.

By this central part 42, which therefore lies on the side of the bearing member 16 opposite the head 30 of the screw 17, it is coupled to the screw 17, although it is free to rotate relative to the latter.

Figure 6:
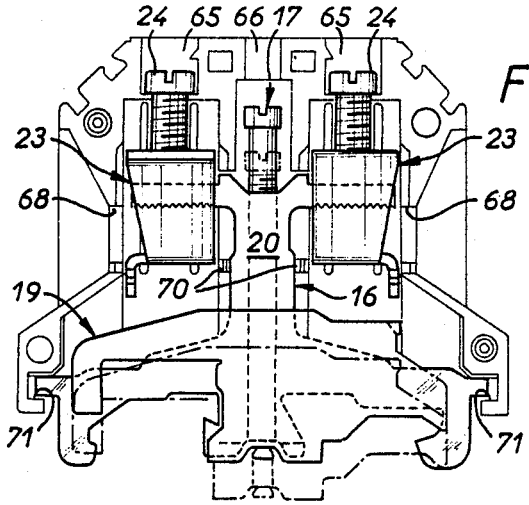
FIG. 6 is a view in elevation of the internal, active part of the terminal block in accordance with the invention, after assembly of its component parts and in particular of the bearing member, the clamping member and the corresponding screw.

The shank 44 of the screw 17 comprises for this purpose an extension 45 of reduced diameter which passes with clearance through the central part 42 of the clamping member 19, by means of a hole 46 provided in the latter for this purpose and which, beyond the central part 42, is burred over, as can be seen in FIGS. 6 and 8.

As an alternative to this, the coupling of the screw 17 to the clamping member 19 could equally well be achieved by crimping or snap-fastener fashion or using an auxiliary component such as a nut or a circlip fitted to its reduced diameter extension 45 beyond the central part 42 of the clamping member 19.

Similarly, the portion of the central part 42 of the clamping member 19 comprising the hole 46 is set back relative to its main part, in a similar way to the recess on the lower surface of the foot member 35 of the bearing member 16; to each side of this recessed portion the central part 42 forms two faces 47 each adapted to cooperate abutment fashion with the bearing studs 36 provided on the foot member 35.

To either side of its central part 42, which is of relatively limited extent, the flanges 43 of the clamping member 19 form two branches 50 which extend in opposite directions on respective sides of the central part 42 and through at least one of which it is adapted to come into contact with a rail 11.

These branches 50 are produced by cutting the flanges 43 appropriately.

The flanges 43 are cut in the same way to achieve this and, to simplify the description, it will be assumed hereinafter that they together constitute a single part.

As with the bearing member 16, each of the branches 50 of the clamping member 19 has at least one face 52, 52' adapted to come into contact with a rail 11.

All the faces 52, 52' face generally away from the head 30 of the screw 17 and thus they all form simple bearing faces each designed to bear on the top of the right-angle lip 12 of one of the side flanges 13 of a rail 11 of this kind.

To be more precise, the clamping member 19 has two bearing faces 52 at the ends of its respective branches 50 which are at substantially the same level on the face of the branches 50 facing away from the head 30 of the screw 17; through them it is adapted to bear on the right-angle lips 12 of the lateral flanges 13 of a hat-shape profile symmetrical rail 11S.

The bearing face 52 on the same side of the screw 17 as the hook 32 of the bearing member 16 towards which the hook 32' of the latter faces is formed at the end of a heel or stud 53, the corresponding branch of the clamping member 19 having a notch 74 through which it can be engaged over the upper right-angle lip 12 of a G-shape profile asymmetric rail 11AS.

Perpendicularly to the axis of the threaded bore 18 in the central shank 20 of the bearing member 16, the back of the notch 74 forms a plane bearing face 52' adapted to bear on the upper right-angle lip 12 of a G-shape asymmetric rail 11AS.

The bearing faces 52, 52' concerned are therefore offset relative to each other.

Figure 4:
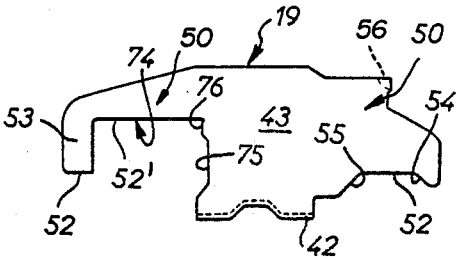
FIG. 4 is similarly a view in elevation of the clamping member, also shown in isolation.
Figure 5:
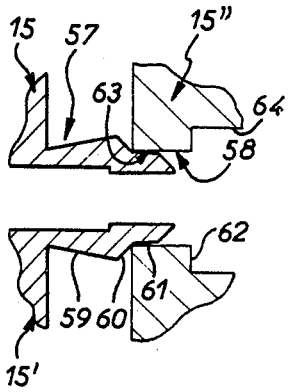
FIG. 5 is a partial view to a larger scale of the housing of the terminal block in accordance with the invention, in cross-section on the line V-V in FIG. 1.

The outermost lateral edge of the notch 74, that is to say that furthest to the left in FIG. 4, is generally rectilinear and extends substantially parallel to the axis of the threaded bore 18 in the central shank 20 of the bearing member 16.

However, for reasons that will emerge later the innermost lateral edge of the notch 74, that is to say that furthest to the right in FIG. 4, has in its central area a cut-out 75 of which at least the flank nearer the back forming the bearing face 52' is oblique.

As shown here, the part 76 of the lateral edge between the cut-out 75 and the bearing face 52' is also rectilinear, parallel to the previously mentioned lateral edge, and therefore parallel to the axis of the threaded bore 18 in the central shank 20 of the bearing member 16, starting from the bearing face 52'.

The other bearing face 52 of the clamping member 19, that on the same side of the clamping screw 17 as the hook 32 of the bearing member 16 with the larger hook face 29, and therefore that on the opposite side of he hook 32' to the latter, is embraced by oblique faces 54, 55 which converge in the direction towards the head 30 of the screw 17.

On the same side as this, the flanges 43 of the clamping member 19 have two tangs 56 facing towards each other on the side of the branch 50 concerned opposite the bearing face 52 in question; these are adapted to cooperate abutment-fashion with the face 39 provided for this purpose on the upper surface of the corresponding lower branch 28 of the bearing member 16.

In a manner that is known in itself the housing 15, which is made from an insulative material, being molded from a synthetic insulative material, for example, has the general form of a parallel sided plate and is formed by two shell members 15', 15" in face-to-face relationship on a median plane of the assembly.

For fastening them together, each of the shell members 15', 15" carries projecting pegs 57 adapted to be inserted in recesses 58 provided on the other of the shell members 15', 15".

There are two such pegs 57 projecting from each of the shell members 15', 15", in diagonally opposed positions relative to each other, and thus also two recesses 58, alternating with the pegs 57.

Each of the pegs 57 has at least two parts of different cross-section.

There are therefore, starting from the root of a peg 57 of this kind, a first substantially frustoconical section 59 which diverges in the direction away from the root and, beyond a median area 60 of maximum diameter, a second section 61 which has a smaller cross-section and is substantially cylindrical.

There is conjointly provided in each of the corresponding recesses 58 a shoulder 62 between a reduced diameter entry part 63 corresponding to the end section 61 of the pegs 57 and a larger diameter main part 64.

To facilitate its insertion into a recess 58 of this kind the edge of the end section 61 of the pegs 57 is chamfered.

In all other respects the housing 15 formed in this way by the two shell members 15', 15" is of the usual conformation.

As such, it will not be described in detail here.

It will suffice to indicate that on its edge it features, equally divided between the two shell members 15', 15" that constitute it, at the front, two lateral wells 65 adapted to provide access to the clamping screws 24 of the terminals 23 and a central well 66 adapted to provide access to the head 30 of the screw 17 and, at the side, two openings 68 adapted to enable the insertion into the terminals 23 of the bared ends of electrical conductors from the circuits to be protected.

On the lower part of the edge of the housing 15 is a slot through which passes the assembly comprising the clamping member 19 and the lower part of the lower branches 28 of the bearing member 16.

For locking the bearing member 16 in position, each of the shell members 15', 15" constituting the housing 15 comprises on the inside two projecting pegs 70 through which it is adapted to embrace laterally the central shank 20 of the bearing member 16 and two lateral grooves 71 in which are inserted the tabs 40 on the bearing member 16.

The assembly may be fitted together in the following way.

The screw 17 is first screwed into the threaded bore 18 in the bearing member 16 until the extension 45 of its shank 44 projects considerably from the other end thereof.

The clamping member 19 is then fitted to the bearing member 16, with its central part 42 engaged over the extension 45 of the shank 44 of the screw 17, by means of the hole 46 provided for this purpose in the central part 42.

The extension 45 is then burred over or crimped.

The clamping member 19 is in this way coupled to the screw 17 and forms with it and the bearing member 16 a unitary assembly.

After the terminals 23 are fitted over the upper branches 22 of the bearing member 16, up to the point where the terminals 23 butt up against the shoulders 25 provided for this purpose on the upper branches 22, this assembly is inserted into one of the shell members 15', 15" of the housing 15.

The other of the shell members 15', 15" of the latter is then placed onto the first, in two stages.

The first stage is relevant only to the end section 61 of the corresponding pegs 57, the function of which end sections 61 is to bring about preliminary centering of the shell members 15', 15" concerned relative to each other.

The shell members 15', 15" are then closed completely during a second stage, during which they become attached to each other snap-fastener fashion, with the central portion 60 of maximum diameter of the pegs 57 engaged with the shoulder 62 in the corresponding recesses 58.

In other words, the provision of two sections of different diameter on the pegs 57 advantageously makes it possible to secure pre-positioning of the two shell members 15', 15" relative to each other and, the shell members 15', 15" having been pre-positioned in this way, their change of position for the final operations to be carried out is facilitated.

Should the shell members 15', 15" be subject to different shrinkage on molding, being made different colors, pegs 57 of this kind advantageously make it possible to make up for the corresponding differential shrinkage.

Be this as it may, it will be readily understood that the operations needed to assemble the terminal block 10 in accordance with the invention may be easily mechanized.

In the terminal block 10 in accordance with the invention the clamping member 19 is movable between a raised position, shown in full line in FIG. 6, and a lowered position, shown in chain-dotted line in figure 6, by the screw 17 to which it is coupled.

Before the terminal block 10 is mounted on a rail 11 its clamping member 19 is moved to the raised position, or at least a position in which it is retracted relative to its lowered position.

In the case of a symmetrical hat-shape profile rail 11S$_1$, as in FIG. 8A, for example, the terminal block 10 in accordance with the invention is offered up slightly slantwise to permit one of the hooks 32 on its bearing member 16 to be inserted under the right-angle lip of one of the lateral flanges 13 of the rail.

For reasons that will emerge hereinafter, it is preferably the hook 32 whose hook face 29 is the larger of the two that secures such engagement.

The terminal block 10 in accordance with the invention is then straightened up and moved transversely relative to the rail 11S$_1$ concerned until the back 33 of the other hook 32 on its bearing member 16 butts up against the edge surface of the right-angle lip 12 of the flange 13 of the rail opposite the previous one, the back 33 advantageously being rectilinear for this purpose.

It will be readily understood that fitting in the manner described is made possible by the fact that the distance D"3 specified hereinabove is greater than the distance D3 between the opposite edge surfaces of the right-angle lips 12 of the symmetrical rail 11S$_1$ concerned.

All that is then required is to tighten down the screw 17 using a screwdriver.

This causes lowering of the clamping member 19, in other words movement of the latter towards its lowered position.

During its downward movement the clamping member 19 bears through its oblique face 54 against the upper edge of the edge surface of the corresponding right-angle lip 12 of the symmetric rail 11S$_1$ concerned and the overall result is a force from the left towards the right in FIG. 8A which leads to the clamping member 19 reinforcing its transverse abutment bearing engagement, through the back 33 of its opposite hook 32, against the edge surface of the other right-angle lip 12 of the rail 11S$_1$ which advantageously avoids any tendency to twisting or torsion of the assembly relative to the rail as a result of the rotational force to which it is subjected by the screwing action.

At the end of its downward movement the clamping member 19 bears through its bearing faces 52 on the upper surface of the right-angle lips 12 of the symmetrical rail 11S$_1$ concerned and, as tightening down of the screw 17 continues, the right-angled lips 12 are firmly gripped between the hook faces 29 on the bearing member 16 and the bearing faces 52 on the clamping member 19.

The process is the same in the case of a symmetrical hat-shape profile rail 11S$_2$ (FIG. 8B).

In either case, it results from what has been described previously that, when fitted, the terminal block 10 in accordance with the invention occupies a precisely identified position on the symmetrical rail to which it is fitted, this position being defined by abutment of the straight back 33 of one of the hooks 32 on its bearing member 16 against the edge surface of one of the right-angle lips 12 of the rail.

Apart from the fact that this controlled positioning guarantees good retention of the terminal block on the rail, it advantageously makes it possible to center the terminal block on the rail.

It is merely necessary to have the back 33 at a designed distance from the axis of the threaded bore 18 in the central shank 20 of the bearing member 16 substantially equal to half the distance D3 between the opposite edge surfaces of the right-angle lips 12 of the rail.

Conjointly with this, by virtue of its relatively large size the hook face 29 of the other hook 32 of the bearing member 16 makes its possible to make up for any variations in the distance D3 between one rail and another.

In the case of an asymmetric G-shape profile rail 11AS, as in FIG. 8C, it is through the hook 32' of the bearing member 16 that the terminal block 10 in accordance with the invention is hooked onto the upper right-angle lip 12 of the rail.

Through its bearing face 38 the bearing member 16 then bears conjointly on the upper surface of the upper right-angle lip 12.

As previously, the terminal block 10 in accordance with the invention is preferably first offered up on the slant and then straightened up and moved transversely relative to the rail 11AS concerned, so that the rectilinear back 33' of its hook 32' butts up transversely against the edge surface of the upper right-angle lip 12 of the latter.

Also as previously, the clamping member 19 is then lowered.

During this downward movement, the notch 74 in the clamping member 19 is engaged over the upper right-angle lip 12 of the asymmetric rail 11AS concerned, until its corresponding bearing face 52' bears on the upper surface of the upper right-angle lip 12.

As will be readily understood this engagement of the clamping member 19 on the upper right-angle lip 12 of an asymmetric rail of this kind is facilitated by the cut-out 75 in the innermost lateral edge of the notch 74.

Conjointly with this, the bearing face 52 of the other branch 50 of the clamping member 19 bears on the upper surface of the lower right-angle lip 12 of the asymmetric rail 11AS concerned.

As the tightening of the screw 17 continues, the upper right-angle lip 12 of the asymmetric rail 11AS is gripped between the hook face 29' of the bearing member 16 and the bearing face 52' of the clamping member 19.

The tangs 56 on the clamping member 19 then prevent the bearing member 16 tilting relative to the upper right-angle lip 12 of the asymmetric rail concerned, the bearing member 16 butting against these tangs 56 through the plane face 39 of its corresponding lower branch 28.

Also, in the case of an asymmetric G-shape profile rail 11AS of this kind, it is the oblique face 55 of the clamping member 19 that, as the latter moves downwards, cooperates with the upper edge of the edge surface of the lower right-angle lip 12 of the rail.

The result of this is a force from right to left in FIG. 8C which, depending on the inevitable manufacturing tolerances, either strengthens the transverse abutment engagement of the back 33' of the hook 32' of the bearing member 16 against the edge surface of the upper right-angle lip of the asymmetric rail concerned, or substitutes the clamping member 19, in this transverse abutment relationship, for the bearing member 16, through the rectilinear part 76 of the innermost lateral edge of its notch 74, as shown.

In practise this rectilinear part 76 of the innermost lateral edge of the notch 74 on the clamping member 19 and the back 33' of the hook 32' on the bearing member 16 are usually in substantial alignment.

Be this as it may, and as previously, once fitted the terminal block 10 in accordance with the invention advantageously occupies a precisely defined position on the asymmetric rail to which it is fitted with the resulting advantages as to good retention and centering.

It is sufficient to have an appropriate designed distance between the axis of the threaded bore 18 in the central shank 20 of the bearing member 16 and the back 33' of the hook 32' and/or the rectilinear section 76 of the innermost lateral edge of the notch 74 on the clamping member 19.

The clamping thus secured in all cases for the terminal block 10 in accordance with the invention makes it possible to minimize the space to be provided for the wiring in the immediate surroundings of the rails to be fitted with terminal blocks.

The process for removing the terminal block 10 in accordance with the invention is the reverse of the process as just described for fitting it.

It is to be understood that the present invention is not limited to the embodiment described and shown, but encompasses any variant execution.

There is claimed:

1. A terminal block adapted to be fixed to a rail of the type having a central portion, opposed flanges extending from said central portion, a right angle lip extending from said flanges remote from said central portion, said terminal block comprising a housing accommodating a metal bearing member and a metal clamping member, said bearing member adapted to be fixed relative to said housing, said clamping member being movable relative to said housing, said bearing member having two lateral branches and an axial bore, a screw having a head and received in said bore, hooks being provided on the respective branches of said bearing member and having lands facing generally in the axial direction of said screw head, said clamping member having lateral branches and bearing lands adapted to come into contact with the rail, said clamping member being of U-shaped cross section and having a central part arranged to a side of said bearing member axially remote from said screw head and said flanges extending from the central portion and embracing said bearing member, said screw having means integral therewith for free rotatable movement relative to said clamping member central part, and for fixing said clamping member for axial movement in either direction with said screw.

2. A terminal block according to claim 1, wherein said screw head is disposed proximate to a top side of said housing, said clamping member being movable between a raised, rest position and a lowered, clamping position, tightening of said crew corresponding to movement of said clamping member towards said lowered position.

3. A terminal block according to claim 1, wherein said bearing member acts in tension and sail clamping member in compression when the terminal block is fixed to the rail.

4. A terminal block according to claim 1, wherein said bearing member has a tap projecting in opposite directions from each of said lateral branches and cooperable with said housing for fixing said bearing member relative to said housing.

5. A terminal block according to claim 1, wherein said one of said lateral branches of said bearing member has a planar face perpendicular to said bore axis and facing in the axial direction of said screw head, said clamping member having tangs cooperable in abutment fashion with said planar face for limiting axial displacement of said clamping member relative to said bearing member.

6. A terminal block according to claim 1, wherein respective bearing faces are provided on said clamping member branches on the side of said clamping member facing axially away from said screw head, said bearing faces being substantially coplanar and adapted to bear on right-angle lips of a symmetrical rail of hat-shape profile.

7. A terminal block according to claim 6, wherein one of said clamping member branches has a heel portion on which one of said bearing faces is provided, said one clamping member branch having a notch facing axially away from said screw head for accommodating an upper surface of a right angle lip of an asymmetrical rail of G-shape profile.

8. A terminal block according to claim 7, wherein said notch has a lateral bight portion forming a planar face perpendicular to the said bore axis and adapted to bear on an upper surface of a right angle lip of an asymmetrical rail of G-shape profile.

9. A terminal block according to claim 7, wherein said notch has a lateral bight portion forming a planar face perpendicular to the said bore axis and adapted to bear on an upper surface of a right angle lip of an asymmetrical rail of G-shape profile, a portion of said notch adjoining said planar face thereof and relatively adjacent said bore axis being substantially parallel to said bore axis and substantially in alignment with a bight portion of said third hook.

10. A terminal block according to claim 1, wherein said hooks are carried by the respective bearing member branches and project from the side of said bearing member axially remote from said screw head, said hook lands being substantially at the same axial level and generally facing towards each other, and said hook lands being cooperable with the right angle lips of a symmetrical rail of hat-shape profile.

11. A terminal block according to claim 10, wherein each of said hooks comprises a bight portion adjoining the respective hook land, said hook lands being slightly oblique and angling from said bight portion away from said screw head and toward said bore axis.

12. A terminal block according to claim 10, wherein each of said hooks comprises a bight portion adjoining the respective hook land, said hook lands being slightly oblique and angling from said bight portion away from said screw head and toward said bore axis, a third hook being provided on the side of said bearing member remote from said screw head and in a central portion between said lateral branches of said bearing member, said third hook facing one of said first and second hooks and having a hook land axially closer to said screw head than said one of said first and second hooks, said third hook being adapted to be hooked onto a right angle lip of an asymmetrical rail of G-shape profile.

13. A terminal block according to claim 12, wherein said hook land of said one of said first and second hooks has a greater transverse dimension from its bight portion to its free edge than that of the other of said first and second hooks.

14. A terminal block according to claim 12, wherein the bearing member branch on which the other of said first and second hooks is carried has a planar face perpendicular to said bore axis adapted to bear on an upper surface of a right angle lip of an asymmetrical rail of G-shape profile.

15. A terminal block according to claim 12, wherein said bearing member has a foot member in the central portion thereof, said third hook being part of said foot member, said foot member having two bearing heels on respective sides of said bore axis, adapted to butt up against said clamping member when said clamping member is in a raised position.

16. A terminal block according to claim 12, wherein said housing comprises two shell members, at least one of said shell members having a least one projecting peg, and at least the other of said shell members having a recess complementary with said peg, detent means provided between said peg and said recess, said at least one peg having at least two parts of different cross section.

17. A terminal block according to claim 12, wherein respective bearing faces are provided on said clamping member branches on the side of said clamping member facing axially away from said screw head, said bearing faces being substantially coplanar and adapted to bear on right-angle lips of a symmetrical rail of hat-shape profile, and oblique faces disposed on respective sides of one of said bearing faces and coverging in the axial direction of said screw head.

18. A terminal block according to claim 17, wherein said one of said bearing faces is disposed on the other side of said bore axis from said third hook.

19. A terminal block according to claim 12, wherein said bore in said bearing member is threaded along a substantial portion of its length and said screw is in threaded engagement therewith.

20. A terminal block according to claim 19, wherein said screw has a shank and said means integral therewith includes a small diameter extension remote from said screw head, said extension being received with clearance in a hole in said central part of said clamping member, said extension having a tip of enlarged diameter for axial securement to said central part while permitting relative rotation.

* * * * *